US005904227A

United States Patent [19]

Whitehall et al.

[11] Patent Number: 5,904,227

[45] Date of Patent: May 18, 1999

[54] METHOD FOR CONTINUOUSLY ADJUSTING THE ARCHITECTURE OF A NEURAL NETWORK USED IN ELEVATOR DISPATCHING

[75] Inventors: Bradley L. Whitehall, Menomonee Falls, Wis.; Theresa M. Christy, West Hartford, Conn.

[73] Assignee: Otis Elevator Company, Farmington, Conn.

[21] Appl. No.: 08/999,158

[22] Filed: Dec. 30, 1997

[51] Int. Cl.[6] ..... B66B 1/16; G08B 21/00

[52] U.S. Cl. ..... 187/380; 187/390; 395/910

[58] Field of Search ..... 187/391, 393, 187/392, 380, 382; 395/910

[56] References Cited

U.S. PATENT DOCUMENTS

| | | | |
|---|---|---|---|
| 5,146,053 | 9/1992 | Powell et al. | 187/127 |
| 5,338,904 | 8/1994 | Powell et al. | 187/137 |
| 5,427,206 | 6/1995 | Powell et al. | 187/387 |
| 5,447,212 | 9/1995 | Powell | 187/382 |
| 5,529,147 | 6/1996 | Tsuji | 187/382 |
| 5,563,386 | 10/1996 | Powell et al. | 187/382 |
| 5,583,968 | 12/1996 | Trompf | 395/2.41 |
| 5,598,510 | 1/1997 | Castelaz | 395/23 |
| 5,668,356 | 9/1997 | Powell et al. | 187/382 |
| 5,672,853 | 9/1997 | Whitehall et al. | 187/380 |

OTHER PUBLICATIONS

"Neural Networks, An Introduction", B. Müller et al, Springer–Verlag Berlin/Heidelberg, 1990, Sec. 5.2.1 and 5.2.2, pp. 46–48.

*Primary Examiner*—Robert E. Nappi

[57] ABSTRACT

A method for adapting to observed special use patterns a neural network used to estimate quantities needed by an elevator dispatching system responsible for assigning the elevator or another elevator to a hall call. Rather than simply refining values of existing connection weights to train the neural network to provide acceptable outputs for predetermined inputs, the method analyzes use information to determine whether additional inputs to the neural network might be advantageous and what those inputs might be. If so, the method alters the neural network architecture by providing new input nodes and corresponding connection weights, the connection weights having initially relatively small values. All connection weights can then be adjusted during actual operation of the elevator to accommodate the new input nodes.

4 Claims, 3 Drawing Sheets

METHOD FOR CONTINUOUSLY ADJUSTING THE ARCHITECTURE OF A NEURAL NETWORK USED IN ELEVATOR DISPATCHING

BACKGROUND OF THE INVENTION

1. Technical Field

The present invention pertains to the field of elevator control. More particularly, the present invention pertains to adding input nodes to a neural network used as part of an elevator dispatching system in response to observing use patterns not adequately encoded by the existing network input nodes.

2. Description of Related Art

Elevator dispatching systems use a number of factors in determining which elevator car is the most appropriate to service a request, called a hall call, issued by someone on a floor in the building serviced by the elevator. An elevator dispatching system often uses as an input a so called remaining response time (RRT) in deciding whether to assign an elevator to service a hall call. The remaining response time may be defined as the estimated time for the elevator to travel from its current position to the floor of the hall call.

Artificial neural networks have recently been applied to the problem of estimating RRT. See, e.g., U.S. Pat. No. 5,672,853 to Whitehall et al. Neural networks have proven useful in estimating RRT, but in implementations so far the architecture of the a neural network has been decided before the neural network is put to use, and not changed to accommodate changing patterns of use of the elevator. The architecture of a neural network encompasses what layers are used, the nodes for each layer, and the connections between the nodes. The connection weights, which express how important the output of a first node is for another node to which the first node is connected, are not intended to be encompassed by the term architecture as it is used here.

Usually, the architecture, and in particular the number of input nodes, is determined before the neural network is ever put into service with the elevator. Then the neural network is trained with some training data that reflects what is known about the use of the elevator at the time of training. By training is meant the application of a learning rule, or learning algorithm, that adjusts the weights to provide that each neural network output corresponds properly to values provided to the input nodes.

According to the prior art, once a neural network is put into operation with an elevator, its architecture is static. In other words, if the building population changes or traffic patterns change, the predetermined inputs may not adequately sort out all the factors on which remaining response time could reasonably depend; then the neural network estimate of remaining response time may not be adequate.

For example, one particular floor of a building may differ significantly from the other floors in its need for elevator service. Normally, inputs to a neural network used to estimate remaining response time in an elevator dispatching system are not specialized to particular floors at the outset, unless the special use is anticipated. Thus, after a neural network is put into operation with an elevator, use information collected by the elevator dispatching system may suggest that a particular floor unexpectedly stands out from the other floors in its need for elevator service. Although the neural network weights can be adjusted during actual operation of the elevator, as disclosed in U.S. Patent Application "Method For Continuous Learning By A Neural Network Used In An Elevator Dispatching System" by Whitehall et al., filed on even date herewith, such adjustment may not adequately account for the special use. The existing inputs may simply not be adequate for the neural network to sort out all of the dependencies that should be included in making a good estimate of remaining response time.

What is needed is a way of implementing a neural network so that it can adapt continuously to observed special use patterns that are not adequately represented by existing inputs.

SUMMARY OF THE INVENTION

The present invention is a method of adapting the architecture of a neural network used in estimating inputs to an elevator dispatching system to account for special use observed in the actual operation of the elevator when existing inputs to the neural network do not adequately encode this special use. The neural network may, for example, be used to estimate the remaining response time for an elevator to respond to a hall call, or may provide estimates of other parameters an elevator dispatching system uses in assigning a hall call to an elevator.

According to the present invention, a neural network is implemented with a particular architecture including predetermined inputs. Then after the elevator is in operation for some time, use information such as might be accumulated by the elevator dispatching system is analyzed to identify possible special use behavior that existing inputs to the neural network might not account for.

If such special use behavior is identified, the method determines additional inputs to the neural network, adds input nodes corresponding to each new input, and adds connection weights from each new input node to each other node of the network, depending on the kind of neural network. For example, in the case of a general feed forward neural network, nodes are organized into layers: an input layer, one or more hidden layers, and an output layer. Each node of a given layer is connected to every node of the subsequent layer, on the way to the output layer, with a connection weight that is determined using a learning rule based on the architecture of the neural network.

In one aspect of the invention, the method is specialized to identify special use floors, and to then adjust the architecture of the neural network by adding two input nodes for each identified special use floor. One input node provides for expressing to the neural network whether, when the elevator dispatching system requests that the neural network estimate a remaining response time to service a hall call, the special floor is on a shortest length path that could yet service the hall call, or is on a path that includes travel to a terminal point in the run of the elevator, either the top of the building or the bottom of the building, before servicing the hall call.

Although the present invention can be practiced by taking the elevator off line when special use behavior is identified and then retraining the neural network with the new input nodes, in an advantageous embodiment of the present invention, the neural network is kept in service and trained using a continuous learning methodology as disclosed for example in U.S. Patent Application "Method For Continuous Learning By A Neural Network Used In An Elevator Dispatching System" by Whitehall et al., filed on even date herewith.

BRIEF DESCRIPTION OF THE DRAWINGS

The above and other features and advantages of the invention will become apparent from a consideration of the subsequent detailed description presented in connection with the accompanying drawings, in which.

BEST MODE FOR CARRYING OUT THE INVENTION

The method of the present invention provides for improving the performance of a neural network used with an elevator to estimate inputs to an elevator dispatching system that might assign the elevator to service a hall call. An example of an input to the elevator dispatching system is the remaining response time (RRT) for servicing a hall call, the RRT value representing an estimate of how long before the elevator would arrive at the floor of the hall call.

Figure 1A:
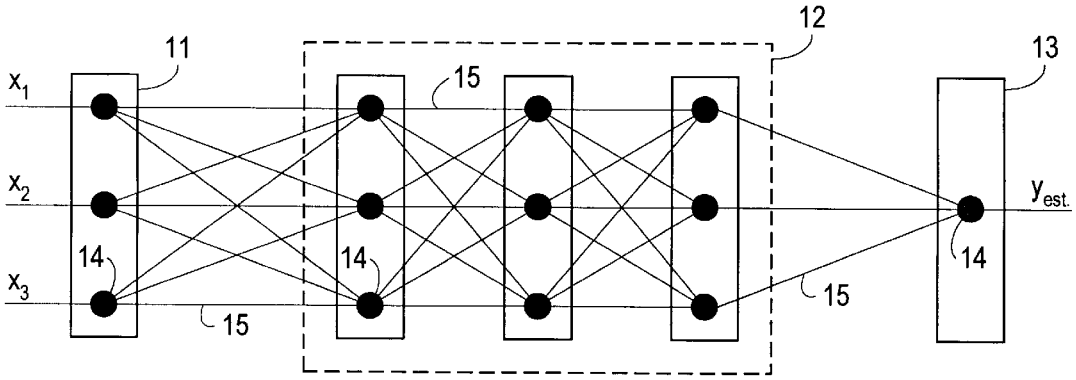
Fig. 1a (Prior art)
FIGS. 1*a* and 1*b* are representations of the general feed forward neural network and a simple perceptron (neural network), respectively.

The method is not intended to be restricted to a neural network of any particular architecture. For example, the method of the present invention could be used with a general feed forward neural network such as shown in FIG. 1*a*. In that case, the neural network would include an input layer 11, hidden layers 12 and an output layer 13, each layer including one or more nodes 14. In a general feed forward neural network, each node 14 is connected with every other node of the next layer. Each node assumes a particular state based on inputs to that node and based on an activation function of the inputs to that node. The state of the node is then propagated to each node of the next layer by connections 15 each having a strength that is determined by training the network, i.e. by changing the weights so that the neural network provides an output for each set of inputs in reasonable accord with observation.

Depending on the architecture of the neural network, different learning rules are used to adjust the weights. In the case of the general feed forward neural network, gradient learning is sometimes used. See for example, *Neural Networks* by B. Müller, and J. Reinhardt, Section 5.2.2. In the case of a simple perceptron (a neural network without hidden layers) much the simpler perceptron learning rule is often used. Id. at section 5.2.1.

Referring still to FIG. 1*a*, inputs $x_1$, $x_2$ and $x_3$ to the general feed forward neural network are shown provided to nodes 14 of the input layer 11. The effect of this input propagates forward from the input layer nodes to, in this illustration, the single node 14 of the output layer 13. This last node provides as its output the value $y_{est}$, an estimate of, for example, the remaining response time of the elevator for servicing a hall call. In other neural network implementations according to the present invention as discussed below, the neural network may have more than one node in the output layer and so may provide more than one estimated parameter to the elevator dispatching system.

In the feed forward neural network of FIG. 1*a,* the state of a node from a given layer is sensed by the nodes of each subsequent layer according to connections 15, each connection having a weight that is adjusted in training the network to produce an acceptable output for a given set of inputs. The effect of the inputs $x_1$, $x_2$ and $x_3$ propagates through the network from the input layer 11 to the output layer 13, first by determining the state of each node in the next adjacent layer. Then the outputs from each of the adjacent layer nodes is fed according to connection weights to each node of a subsequent layer, and so on until the state of the node of the output layer 13 is determined.

Figure 1B:
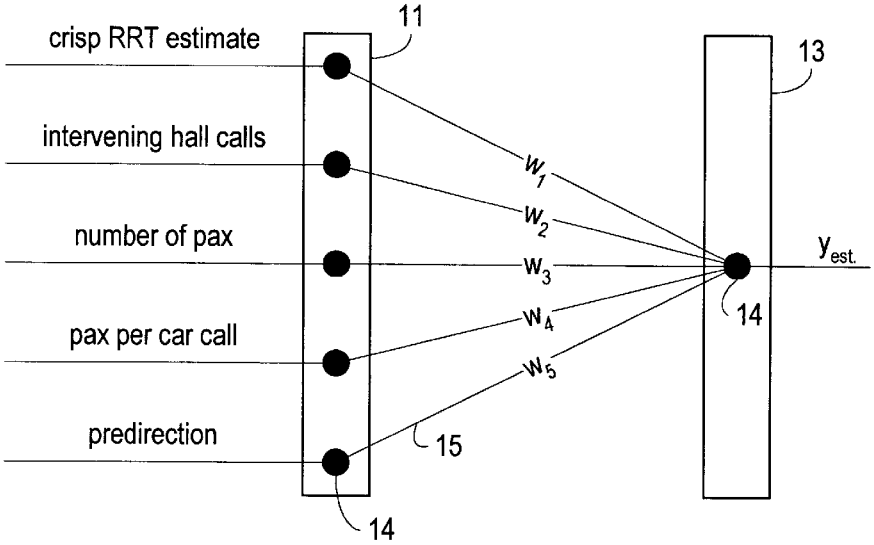
Fig. 1b (Prior art)

In some applications of neural networks in an elevator dispatching system it is found that hidden layers are not necessary. Referring now to FIG. 1*b,* a feed forward neural network without hidden layers, called then a simple perceptron, is shown. Some inputs to a simple perceptron are shown when estimating for an elevator dispatching system the remaining response time for the elevator to service a hall call. In this case, each node 14 of the input layer 11 is connected only to a single node 14 of the output layer 13 with weights $w_1, w_2, \ldots, w_5$ associated with the connections. In a particularly simple application of even a simple perceptron, the output of the neural network $y_{est}$, i.e. the state of the node in the output layer 13, is simply the weighted sum of the inputs $x_i$ to the neural network:

$$y_{est} = \sum_{i=1}^{5} w_i x_i.$$

Sometimes, though, the inputs $x_i$ are scaled so as to all fall within a predetermined range.

Figure 2:
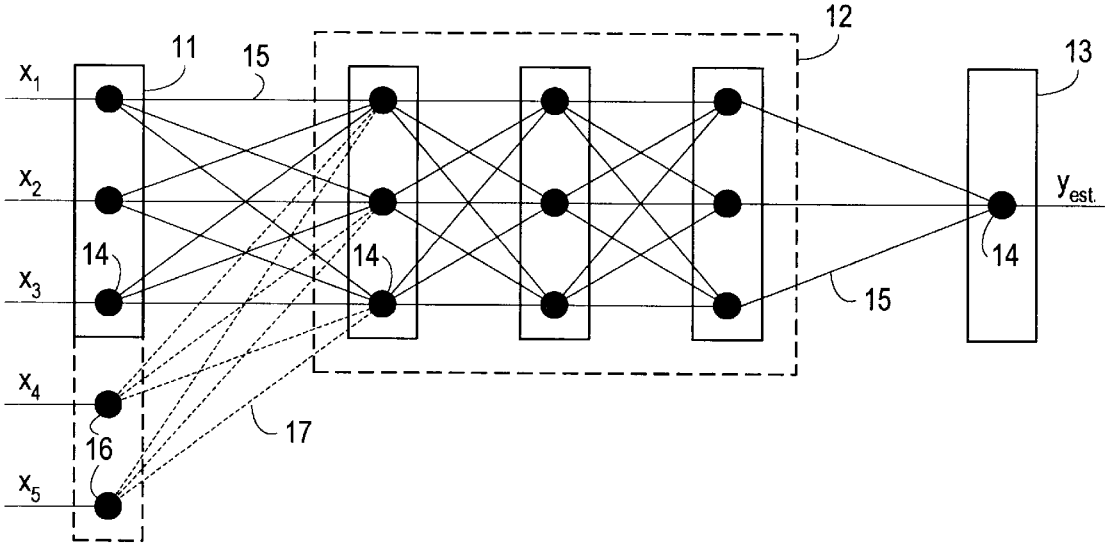
FIG. 2 is a representation of the general feed forward neural network adapted according to the present invention.

Referring now to FIG. 2, a neural network is shown modified according to the present invention to account for special use behavior. For example, in the case of an elevator in a building with a floor open to the public for access to government benefits or services, there may be a large volume of traffic and almost all traffic for that floor will be to and from the ground floor.

Of course, a neural network can be provided with input nodes to account for this special floor during implementation. However, it is possible that a floor will be converted to such special use after installing the elevator system servicing the building. In that case it is still possible to pull the elevator off line and reconfigure the neural network if it appears that the special use is not adequately accounted for by the existing architecture, but doing this requires sending an engineer to the site, and is expensive. Moreover, it is possible that an engineer would be sent to examine operation of the elevator in view of possible special use, and after analysis of the information collected by the elevator dispatching system, determine that the change in architecture of the neural network is not warranted.

In the method of the present invention, analysis of the use information collected by the elevator dispatching system can be analyzed periodically by, for example, an expert system, and a determination made by this automated system whether to add nodes to the input layer to account for special use. In the case of special use having to do with a special floor, in the preferred embodiment, as shown in FIG. 2, two input nodes 16 are added to the network. Then each input node is provided with connection weights for providing its output to each node of the next layer in the network. These weights are associated with connections 17 and are, when the new nodes 16 are first added to the network, given values that are small compared to typical values of the weights of existing connections 15. All of the weights are then adjusted by training, which can be performed continuously, as explained in U.S. Patent Application, "Method For Continuous Learning By A Neural Network Used In An Elevator Dispatching System" by Whitehall et al., filed on even date herewith, or can be performed by taking the neural network off line and retraining the network with the additional nodes using training data updated to reflect the special use.

In a particular application of the present invention, two nodes are added to the input layer of a neural network after an expert system identifies a special floor for which input nodes are not already specially provided. In deciding whether to add the nodes, the expert system would first analyze data acquired by the elevator dispatching system. The expert system would analyze data for identifying special use periodically, for example, once per week. In many elevator systems, the elevator dispatching system already tracks use patterns that can reveal special floors.

An alternative to use of an expert system is to provide an autonomous agent for keeping track of statistical measures of the use pattern from each floor. The agent might, for example, identify special use by searching for a floor from which a number of hall calls originated that is at least two standard deviations from the mean of hall calls from all other floors. As another alternative to the use of standard deviation as a measure of special use, a simple threshold could be used. For example, if one floor has 50% more hall calls than any of the other floors, then it might be identified as a special floor.

When a special floor is identified, the automated system for identifying a special floor directs an autonomous agent to add two nodes to the neural network for an elevator servicing the special floor. One of the new nodes has as an input whether the special floor is on a so called minimum path at the time of the hall call to the elevator. The other new node has as an input whether the special floor is on a so called maximum path at the time of the hall call. The maximum path is the path the elevator would take in reaching a call, only allowing turnarounds at the top and bottom of the building, and only allowing the elevator to stop when it is at the floor of the hall call and moving in the call's direction of travel (known by whether the caller pushed the button to signal a request to go up or the button to go down). The minimum path is similar to the maximum path except that turnarounds are permitted as soon as commitments in the current direction of elevator travel have been satisfied. In calculating the minimum path, a hall call is assumed to have only a single destination, exactly one floor away from the call. A minimum path can never be longer than a corresponding maximum path.

In the case of a fully software implementation of a neural network, the network architecture can automatically be extended to accommodate the two new nodes for the special floor. One simple way to arrange for this is to use a structure file to hold all information about the architecture of a neural network as well as its connection weights. Then the autonomous agent simply alters the structure file to extend the neural network architecture. Finally, an automated neural network manager refers to the structure file to engage the network.

Once a special floor is identified and two new nodes are added to the input layer, the weights of the connections from the two new nodes to each node of the next layer in the network must be given some initial values. To be safe, these initial values should be small compared to typical values of the existing connection weights. Larger values can of course be used instead, but the usual experience is that it is easier for a neural network to learn to appreciate a new input than it is for the network to learn a new input is not as important as first thought.

Finally, the neural network should be trained with the new nodes. This can be done automatically by an autonomous agent presenting data accumulated over the course of operation of the elevator, that data then exhibiting the special use. In this case, the neural network might be taken off line, but not the elevator, and conventional software used in place of the neural network until the network completes its upgrade training. However, in the preferred embodiment, after new nodes are added and new connection weights are given small values, the new weights and the previously existing weights are all adjusted using continuous training as disclosed, for example, in U.S. Patent Application, "Method For Continuous Learning By A Neural Network Used In An Elevator Dispatching System" by Whitehall et al., filed on even date herewith.

Figure 3:
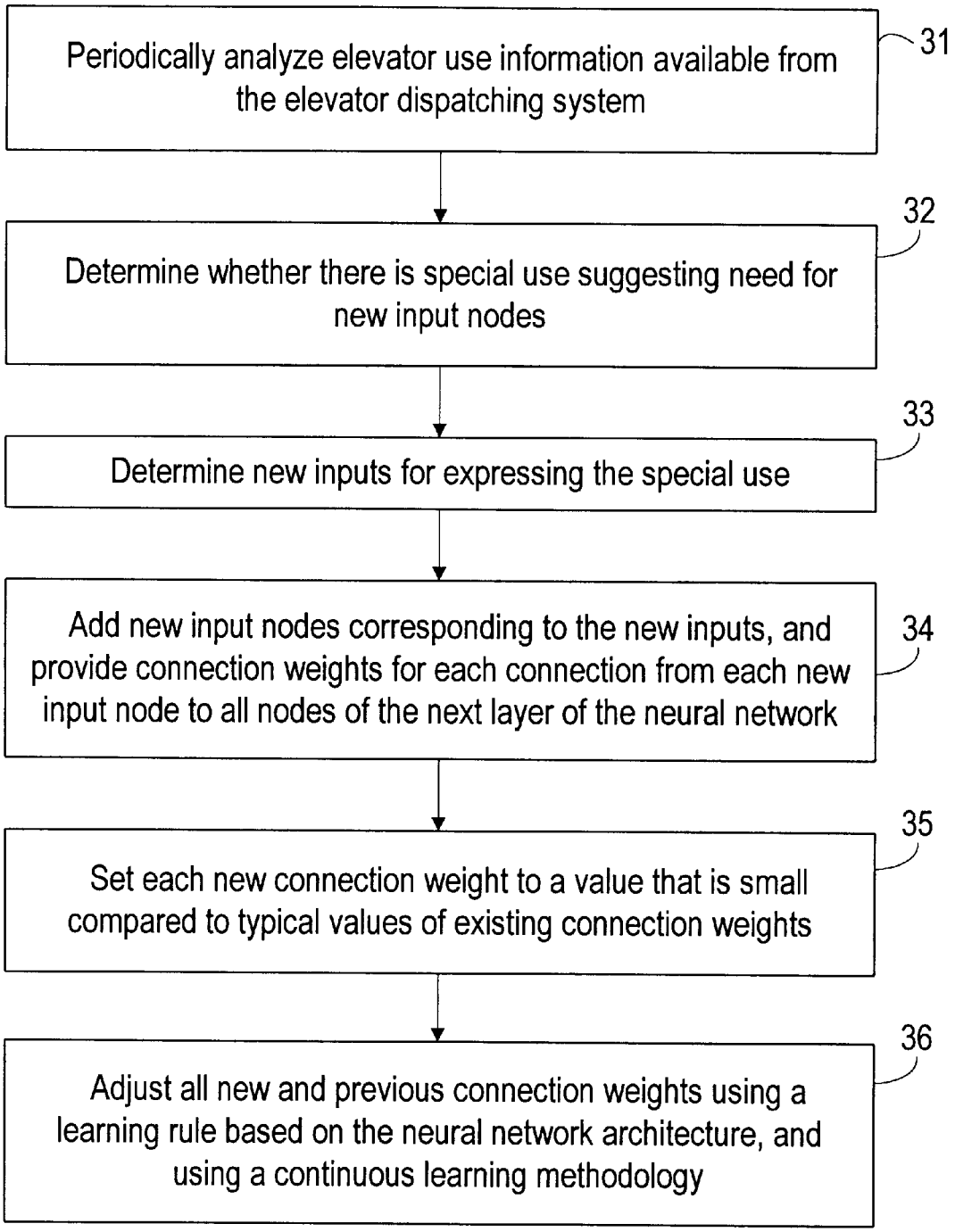
FIG. 3 is process diagram showing the method of the present invention.

Referring now to FIG. 3, the method of the present invention is shown as a process chart in the case of a general neural network providing estimates of a control parameter for use by an elevator dispatching system. In step 31, an autonomous agent analyzes elevator use information collected by the elevator dispatching system. This analysis is performed periodically, perhaps weekly. In step 32, the autonomous agent determines whether there is special use suggesting the need for new input nodes. The autonomous agent knows the structure of the neural network, and also knows what special use has already been specially accounted for by the neural network.

In step 33, the autonomous agent selects from a list of alternatives what new inputs would best express the observed special use. For example, in the case of special use because of a special floor as described above, the autonomous agent would, in the preferred embodiment, add two new inputs for the special floor, one corresponding to whether the special floor is on a maximum path and the other corresponding to whether the special floor is on a minimum path when a hall call is received.

In next step 34, the autonomous agent adds new input nodes corresponding to the new inputs, and provides connection weights for each connection from each new input node to all nodes of the next neural network layer. The autonomous agent performs this modification to the neural network architecture by changing the content of a structure file that describes the nodes and layers of the network and the connection weights between the nodes.

In step 35, the autonomous agent sets the initial values of the new connection weights to a value that is small compared to typical values of the existing connection weights. These values would usually be only about 10% of a typical value of an existing connection weight.

Finally, in step 36, the neural network continues in operation and uses a learning rule to adjust both the new connection weights and the previously existing connection weights during actual operation of the elevator. In the case of a general feed forward neural network, the learning rule is advantageously the gradient rule; in the case of a simple perceptron, the learning rule is advantageously the perceptron learning rule.

It is to be understood that the above-described arrangements are only illustrative of the application of the principles of the present invention. In particular, the term continuous as used here is not intended to limit the present invention to any regular schedule of review and possible updating of an elevator's neural network architecture, but only an ongoing reappraisal of the architecture in view of observed use of the elevator. Numerous modifications and alternative arrangements may be devised by those skilled in the art without departing from the spirit and scope of the present invention, and the appended claims are intended to cover such modifications and arrangements.

What is claimed is:

1. A method for adapting to use patterns a neural network associated with an elevator, the neural network for providing information to an elevator dispatching system, the neural network having layers of nodes with each node of a given layer having a connection weight for connection to each node of a next layer, the method comprising the steps of:

(a) periodically analyzing information about use of the elevator;

(b) determining whether the use information demonstrates a special use pattern not adequately expressed to the neural network by existing inputs to the neural network;

(c) determining new inputs that express the special use pattern;

(d) for each new input adding new input nodes to the neural network and providing for a connection weight for a connection from each new node to each existing node of the next layer; and (e) setting each connection weight of the new node to a value that is small compared to typical values of the existing connection weights;

whereby the neural network is continuously adapted to use patterns of the elevator.

2. A method as claimed in claim 1, wherein the neural network is used to estimate remaining response time to service a hall call, and wherein the special use pattern is for use from a special floor.

3. A method as claimed in claim 2, wherein two new input nodes are provided whenever a special floor is identified, one node for indicating whether the special floor is on a shorter path the elevator might follow in servicing the hall call, and one for indicating whether the special floor is on a longer path the elevator might follow in servicing the hall call.

4. A method as claimed in claim 3, further comprising the step of adjusting the new connection weights by training during actual operation of the elevator.

* * * * *